US006241533B1

(12) United States Patent
Matsumoto

(10) Patent No.: US 6,241,533 B1
(45) Date of Patent: Jun. 5, 2001

(54) PRESS-CONTACT ELECTRICAL INTERCONNECTORS AND METHOD FOR PRODUCING THE SAME

(75) Inventor: Shuzo Matsumoto, Shiojiri (JP)

(73) Assignee: Shin-Etsu Polymer Co., Ltd., Tokyo (JP)

( * ) Notice: Subject to any disclaimer, the term of this patent is extended or adjusted under 35 U.S.C. 154(b) by 0 days.

(21) Appl. No.: 09/483,910

(22) Filed: Jan. 18, 2000

(30) Foreign Application Priority Data

Jan. 21, 1999 (JP) ..... 11-013544
Feb. 3, 1999 (JP) ..... 11-026488

(51) Int. Cl.[7] ..... H01R 12/00
(52) U.S. Cl. ..... 439/67; 439/66; 439/91
(58) Field of Search ..... 439/66, 67, 86, 439/91, 81

(56) References Cited

U.S. PATENT DOCUMENTS

| | | | | |
|---|---|---|---|---|
| 3,924,915 | * | 12/1975 | Conrad | 439/66 |
| 3,998,512 | * | 12/1976 | Anhalt et al. | 439/66 |
| 4,008,938 | * | 2/1977 | Anhalt et al. | 439/71 |
| 4,203,203 | | 5/1980 | Gilissen et al. | 29/846 |
| 4,720,269 | * | 1/1988 | Haskins et al. | 439/86 |
| 4,815,979 | | 3/1989 | Porter | 439/62 |
| 5,259,770 | | 11/1993 | Bates et al. | 439/66 |

FOREIGN PATENT DOCUMENTS

| | | |
|---|---|---|
| 196 05 661 A1 | 8/1996 | (DE) . |
| 0 418 525 A 2 | 3/1991 | (EP) . |
| 2796872 | 12/1991 | (JP) . |
| 105174 | 4/1992 | (JP) . |
| 115577 | 5/1997 | (JP) . |

* cited by examiner

*Primary Examiner*—Tulsidas Patel
(74) *Attorney, Agent, or Firm*—Darby & Darby

(57) ABSTRACT

A press-contact electrical interconnector for interconnecting an electronic circuit board and a subject electronic circuit board by being inserted between them is comprised of an insulative foam elastomer; an insulative rubber sheet having a section roughly in a U shape which covers the surface, one side and the backside of the insulative foam elastomer, while exposing the both end faces and the other side of the insulative foam elastomer; a plurality of conductive threads adhered and secured roughly in a U shape on the insulative rubber sheet and provided in proximity in a row arrangement at roughly equal pitches in the direction of from one end face toward the other end face of the insulative foam elastomer; and an insulative protective rubber sheet of high hardness provided on the other side of the insulative foam elastomer. Either one of the plurality of conductive threads on the surface of the insulative rubber sheet and the plurality of conductive threads on the backside thereof is made to be capable of contacting with the electronic circuit board, the other being capable of contacting with the subject electronic circuit board, or still furthermore an insulative deformation-restraining rubber sheet of high hardness is adhered and secured to the plurality of conductive threads on one side of the insulative rubber sheet.

4 Claims, 5 Drawing Sheets

PRESS-CONTACT ELECTRICAL INTERCONNECTORS AND METHOD FOR PRODUCING THE SAME

BACKGROUND OF THE INVENTION (1) Field of the Invention

The present invention relates to a press-contact electrical interconnector used for interconnecting a liquid crystal display and a circuit board or interconnecting circuit boards, and an improvement of the method for producing the same.

(2) Description of the Prior Art

There are various kinds of press-contact electrical interconnectors, but recently a U-shape metal line interconnector has been used for interconnecting a liquid crystal display and a circuit board or interconnecting circuit boards. The U-shaped metal line interconnector comprises, as shown in FIG. 1, an insulative foam elastomer 15 formed into a block having a section roughly in a half oval shape by using a sponge silicone rubber material; an insulative rubber sheet 2A having a section roughly in a U shape attached to the surface, a curved one side and the backside on the periphery of the insulative foam elastomer 15 by covering them; and a plurality of conductive threads 3 bonded and secured in a U shape on the surface of the insulative rubber sheet 2A and provided in proximity in a row arrangement in parallel at equal pitches in the direction of from one end face to the other end face of the insulative foam elastomer 15*s*.

The metal line interconnector in a U shape constructed in this manner is pressed against and clamped between an unillustrated electrode of an electronic circuit board, serving as an electrical joiner and an unillustrated electrode of a subject electronic circuit board, serving as an object to be electrically interconnected, to thereby press the electronic circuit board with a pressure, causing elastic deformation in the electronic circuit board. Hence, the electronic circuit board and the subject electronic circuit board are interconnected electrically and softly with a plurality of conductive threads 3.

Prior art technical references include Japanese Patent Application Laid-Open Hei 9 No. 115577, Japanese Patent Publication Hei 7 No. 105174 and Japanese Patent No. 2796872.

The conventional press-contact electrical interconnector 17 is simply formed by using only a sponge silicone rubber, as described above, hence it has a feature that it easily sticks and lacks a slip property. Therefore, if the height of the electrical interconnector 17 is high, incorporation workability is deteriorated, and interconnection between the electronic circuit board and the subject electronic circuit board becomes very unstable, often causing non-conductivity. As a result, non-interconnection between the electronic circuit board and the subject electronic circuit board occurs, to thereby cause a big problem that the quality thereof cannot be stabilized.

Moreover, the conventional press-contact electrical interconnector is constructed as described above, and has a disposition pitch of the conductive threads 3 as narrow as 50 $\mu$m to 100 $\mu$m, and a diameter of each conductive thread 3 as small as 30 $\mu$m to 40 $\mu$m. Hence, even a small force applied to press the conductive threads 3 can cause deformation in the conductive threads, causing such a problem that the percent defective of products such as mobile phones becomes high. Furthermore, since the surface of the electrical interconnector 17 is easily deformed by only the application of a small force, the interconnection between the electronic circuit board and the subject electronic circuit board becomes very unstable, causing such a problem that it lacks incorporation workability.

SUMMARY OF THE INVENTION

In view of the above situation, it is an object of the present invention to provide a press-contact electrical interconnector which can improve a slip property to improve incorporation workability, stabilize the interconnection between an electrical joiner and an object to be electrically interconnected and stabilize the quality, and a method for producing the same.

Moreover, in view of the above situation, it is an another object of the present invention to provide a press-contact electrical interconnector which can prevent the percent defective of products from increasing due to the deformation caused on a conductive threads or the surface of an electrical interconnector by a small force, and can stabilize the interconnection between an electrical joiner and an object to be electrically interconnected and further improve incorporation workability.

With a view to attaining the above objects, the gist of the present invention is as follows.

A first gist of the present invention is a press-contact electrical interconnector for interconnecting an electrical joiner and an object to be electrically interconnected by being disposed between the electrical joiner and the object to be electrically interconnected, wherein the electrical interconnector comprises an insulative foam elastomer formed in a columnar shape having a section roughly in a U shape; an insulative rubber sheet having a section roughly in a U shape, which covers a part of the periphery of the insulative foam elastomer; and a plurality of conductive threads provided roughly in a U shape on the surface of the insulative rubber sheet and juxtaposed at roughly equal pitches in the direction of from one end face toward the other end face of the insulative foam elastomer, the both end faces of the insulative foam elastomer being formed as an insulative exposed face, respectively, and an insulative protective rubber sheet of high hardness being provided in an exposed state on the remaining part of the periphery of the insulative foam elastomer.

A second gist of the present invention is a press-contact electrical interconnector for interconnecting an electrical joiner and an object to be electrically interconnected by being pinched between the electrical joiner and the object to be electrically interconnected, wherein the electrical interconnector comprises an insulative foam elastomer; an insulative rubber sheet having a section roughly in a U shape which covers the surface, one side and the backside of the insulative foam elastomer, while exposing the both end faces and the other side of the insulative foam elastomer; a plurality of conductive threads provided roughly in a U shape on the insulative rubber sheet and juxtaposed at roughly equal pitches in the direction of from one end face toward the other end face of the insulative foam elastomer; and an insulative protective rubber sheet of high hardness provided on the other side of the insulative foam elastomer;

either one of the plurality of conductive threads on the surface of the insulative rubber sheet and the plurality of conductive threads on the backside thereof being capable of contacting with the electrical joiner, the other being capable of contacting with the object to be electrically interconnected, and the plurality of conductive threads on one side of the insulative rubber sheet being provided with an insulative deformation-restraining rubber sheet of high hardness.

A third gist of the present invention is a method for producing a press-contact electrical interconnector for interconnecting an electrical joiner and an object to be electrically interconnected through conductive threads, by being disposed between the electrical joiner and the object to be electrically interconnected, using an insulative rubber sheet having a plurality of conductive threads disposed on the surface in parallel to each other, a die having a molding space roughly in a U shape in section, and a laminated foam obtained by laminating an insulative protective rubber sheet of high hardness and an insulative foam elastomer material, which comprises:

a process of receiving the insulative rubber sheet in a roughly U shape in section in the molding space of the die, directing the plurality of conductive threads toward the molding face of the molding space, and inserting the laminated foam in the insulative rubber sheet with the protective rubber sheet facing the opening of the insulative rubber sheet;

a process of clamping, heating and pressing the die, to foam and mold the insulative foam elastomer material of the laminated foam, as well as integrating the insulative foam elastomer, the insulative rubber sheet and the protective rubber sheet to thereby mold an electrical interconnector molded article wherein the protective rubber sheet is exposed on the remaining part of the periphery of the insulative foam elastomer; and a process of cutting the electrical interconnector molded article taken out from the opened die into a predetermined length.

A fourth gist of the present invention is a method for producing a press-contact electrical interconnector for interconnecting an electrical joiner and an object to be electrically interconnected through conductive threads by being pinched between the electrical joiner and the object to be electrically interconnected, using an insulative rubber sheet having a plurality of conductive threads disposed in parallel to each other, a sheet laminate obtained by providing an insulative deformation-restraining rubber sheet which is of high hardness and not vulcanized on the base material sheet, a die having a molding space roughly in a U shape in section, and a laminated foam obtained by providing an insulative protective rubber sheet of high hardness on an insulative foam elastomer material, which comprises:

a process of receiving the sheet laminate in the molding space of the die, as well as receiving the insulative rubber sheet having the plurality of conductive threads exposed outside, by bending it roughly in a U shape in section, to thereby bring the plurality of conductive threads in the bottom of the insulative rubber sheet into contact with the deformation-restraining rubber sheet of the sheet laminate, and inserting the laminated foam into the insulative rubber sheet with the insulative protective rubber sheet facing toward the opening of the insulative rubber sheet;

a process of clamping, heating and pressing the die, to adhere the deformation-restraining rubber sheet of the sheet laminate and the plurality of conductive threads in the bottom of the insulative rubber sheet, as well as foaming the insulative foam elastomer material of the laminated foam to form the insulative foam elastomer, and integrating the insulative rubber sheet and the insulative foam elastomer, and the insulative foam elastomer and the insulative protective rubber sheet to thereby mold an electrical interconnector intermediate body wherein the deformation-restraining rubber sheet and the insulative protective rubber sheet are exposed, respectively; and a process of opening the die, taking out the electrical interconnector intermediate body to thereby remove the base material sheet of the sheet laminate, and dividing the electrical interconnector intermediate body into a predetermined length to obtain the electrical interconnector.

According to the present invention, a protective rubber sheet containing a filler in a large amount is provided on the remaining part of the periphery of the insulative foam elastomer, hence the slip property is improved due to the roughness of the exposed face of the protective rubber sheet.

Moreover, according to the present invention, if an electrical interconnector is disposed between an electrical joiner and an object to be electrically interconnected, either one of the plurality of conductive threads on the surface of the insulative rubber sheet or the plurality of conductive threads on the backside thereof is brought into contact with the electrical joiner, and the other is brought into contact with the object to be electrically interconnected, and thereafter the electrical joiner and the object to be electrically interconnected are brought close to each other, the electrical interconnector is elastically deformed to thereby electrically interconnect the electrical joiner and the object to be electrically interconnected with a plurality of conductive threads. At this time, the deformation-restraining rubber sheet provided on at least a part of one side which is not involved in the interconnection of the electrical joiner and the object to be electrically interconnected restrains unnecessary deformation of the conductive threads and the electrical interconnector.

DESCRIPTION OF THE PREFERRED EMBODIMENTS

Figure 1:
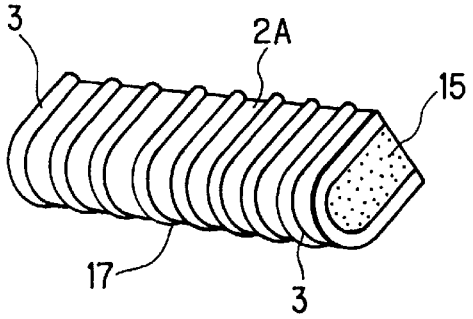
FIG. 1 PRIOR ART
FIG. 1 is a perspective view showing a conventional press-contact electrical interconnector.

First, an electrical joiner and an object to be electrically interconnected in the present invention include various electric and electronic parts represented by a liquid crystal display (COG, TAB), a circuit board, an electronic circuit board, printed board, or a build-up wiring board. Moreover, insulative foam elastomers include various elastomer materials, specifically, butadiene type copolymers such as butadiene-styrene, butadiene-acrylonitrile, butadiene-isobutylene, etc., chloroprene polymer, vinyl chloride-vinyl acetate copolymer, polyurethane, or silicone rubber or a foam thereof. Among them, sponge silicone rubber which is excellent in heat resistance, cold resistance, weatherability and electric insulating property and is nontoxic is preferably used as an elastomer material. Moreover, a roughly U shape includes C shape, U shape, inverse C shape, and shapes similar to them.

As insulative rubber sheets, there are used insulative rubber sheets obtained by applying a rubber material having a rubber hardness of from 20° H to 60° H selected from a chloroprene rubber, a silicone rubber, an isoprene rubber, a butyl rubber, a fluorine rubber or a urethane rubber on a polyester film or a polyimide film such as polyethylene terephthalate, polybutylene terephthalate, or polyethylene nitrile, in a thickness of from about 50 to 200 $\mu$m by a general method such as topping or the like. The tolerance of this thickness is preferably less than or equal to ±5 $\mu$m, more preferably from 0 $\mu$m to 3 $\mu$m. This is because if the tolerance in thickness (Rmax) exceeds 10 $\mu$m. disposition pitch of the conductive threads tends to be easily disturbed.

The reason why the rubber hardness of the insulative rubber sheet is from 20° H to 60° H, preferably from 30° H to 50° H is that if the rubber hardness is less than 20° H, the rubber material slackens due to being unvulcanized at the time of disposing the conductive thread, and the disposition pitch of the conductive thread becomes disturbed. Moreover, if the rubber hardness is larger than 60° H, the disposition pitch of the conductive thread becomes disturbed as well. To obtain the insulative rubber sheet, preferably a rubber material kneaded through two to three calender rolls is discharged by fraction onto a non-contractable (not higher than 5%) base material sheet such as PET or the like. As a rubber material, a silicone rubber excellent in rubber resilience, heat resistance, cold resistance, environmental resistance and mechanical properties is best suited.

As the conductive threads, there can be used metal threads comprising gold, gold alloy, platinum, copper, aluminum, aluminum-silicon alloy, brass, German silver, phosphor bronze, beryllium bronze, nickel, molybdenum, tungsten, stainless steel or the like; or conductive threads obtained by plating a material excellent in conductivity and weatherability such as gold, gold alloy or rhodium on the above described metals. Among them, metal lines or gold-plated metal threads having excellent conductivity and weatherability and a low contact property is preferable.

The thickness of each conductive thread is from 3 to 500 $\mu$m, preferably from 10 to 100 $\mu$m, and more preferably from 15 to 50 $\mu$m. This is because if it is too thin, it tends to be broken at the time of wiring, and if it is too thick, precise wiring pitch cannot be obtained, it becomes difficult to bend it along the molding space of the die since flexural elasticity becomes strong more than necessary at the time of bending and receiving it in the die. Moreover, each conductive thread has preferably such a thickness that 30 to 80%, preferably 40 to 60% of the conductive thread is provided on an unvulcanized insulative rubber sheet in a buried condition.

Furthermore, a metal slit foil is included in the conductive thread other than the above-mentioned conductive threads. As the metal slit foil, metal slit foils comprising iron, stainless steel, copper, copper-titanium alloy or the like, or metal slit foils obtained by plating a material excellent in conductivity and weatherability such as gold, gold alloy or rhodium on the these metals can be used. However, a metal thread or a gold-plated metal slit foil having excellent conductivity, weatherability and a low contact property is preferable. As the metal slit foil, the one having, for example, a thickness of 20 $\mu$m, a pitch of 70 $\mu$m, and a width in the metal conductor portion of 30 $\mu$m is used.

As the insulative protective rubber sheet and the deformation-restraining rubber sheet used in the second embodiment, for example, there is used a rubber sheet obtained by applying a rubber material having a high rubber hardness selected from a chloroprene rubber, a silicone rubber, an isoprene rubber, a butyl rubber, a fluorine rubber or a urethane rubber, on a polyester film or a polyimide film such as polyethylene terephthalate, polybutylene terephthalate, or polyethylene nitrile, by a general method such as topping or the like. To obtain the insulative protective rubber sheet and the deformation-restraining rubber sheet, preferably a rubber material kneaded through two to three calender rolls is discharged by fraction onto a non-contractable (not higher than 5%) base material sheet such as PET or the like.

As a rubber material, a silicone rubber excellent in environmental resistance, mechanical properties, resilience, heat resistance, cold resistance, weatherablity, moisture resistance, chemical resistance, aging resistance and electric insulating property is preferable. Moreover, the thickness thereof is preferably from 50 to 500 μm, more preferably from 80 to 150 μm, which is the range that the electrical interconnector is not made larger than necessary. Moreover, the rubber hardness is preferably higher than or equal to 60° H, more desirably higher than or equal to 80° H. With such an insulative protective rubber sheet having high rubber hardness, interconnection with low load and low compression quantity becomes possible at the time of interconnection using the electrical interconnector, thereby reliability of interconnection can be improved.

Preferred embodiments of the present invention will now be described with reference to accompanying drawings, but the present invention is by no means limited to these embodiments.

Figure 2A:
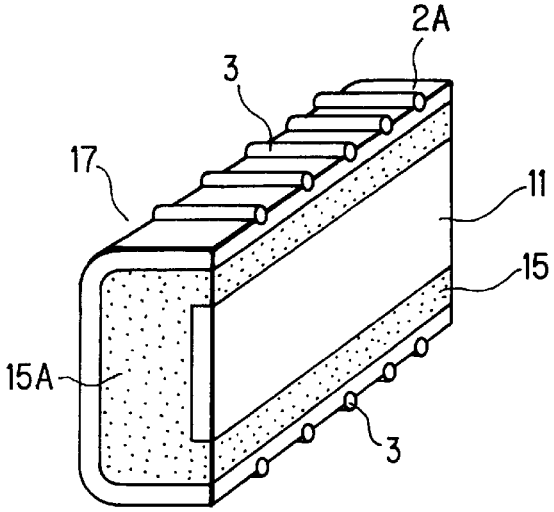
FIG. 2A is a perspective view showing a first embodiment of a press-contact electrical interconnector according to the present invention.
Figure 2B:
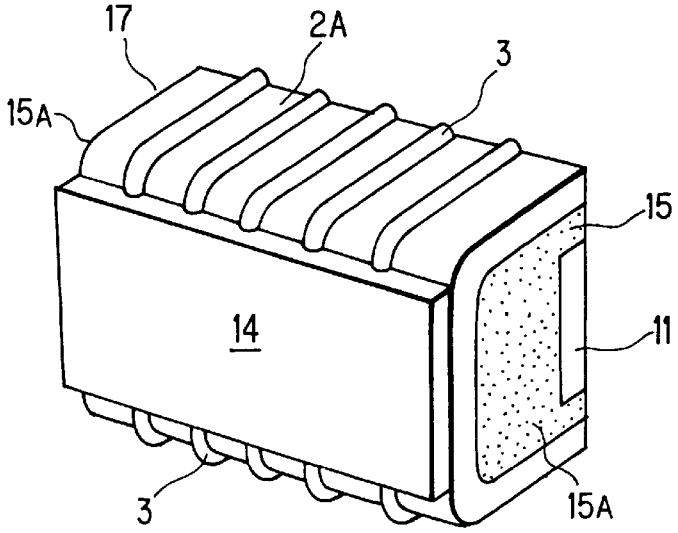
FIG. 2B is an overall perspective view showing a second embodiment of a press-contact electrical interconnector according to the present invention.

In a press-contact electrical interconnector in this embodiment, as shown in FIGS. 2A and 2B which are a first and a second embodiments, an electrical interconnector 17 for interconnecting unillustrated electronic circuit board and subject electronic circuit board is constituted by an insulative foam elastomer 15, an insulative rubber sheet 2A having a section roughly in a U shape which is coated and formed on the periphery of the insulative foam elastomer 15; a plurality of conductive threads 3 provided in proximity in a row arrangement on the insulative rubber sheet 2A; an insulative protective rubber sheet 11 provided on the other side of the insulative foam elastomer 15 in a buried condition; and in the second embodiment as shown in FIG. 2B, a deformation-restraining rubber sheet 14 adhered and secured on the plurality of conductive threads on one side of the insulative rubber sheet 2A.

The insulative foam elastomer 15 is molded in a roughly rod shape by using a silicone rubber material 12 (foaming ratio: 1.3 to 1.7 times) excellent in resilience, heat resistance, cold resistance, weatherablity, moisture resistance, chemical resistance, aging resistance and electric insulating property. Moreover, the insulative rubber sheet 2A is attached by winding to cover the surface, one side and the backside on the periphery of the insulative foam elastomer 15, to thereby make the both end faces 15A and the other side of the insulative foam elastomer 15 an insulative exposed face, respectively. The size of the both end faces 15A serving as the exposed face is from 0.2 to 0.3 mm, though depending upon the width and pitch of the electrodes to be interconnected. With this size, the electrical interconnector 17 is not made bigger than required, and design of the interconnected circuit (electrode form) is not adversely affected.

A plurality of conductive threads 3 are provided in proximity in a row arrangement in parallel at equal pitches in the direction of from one end face of the insulative foam elastomer 15 to the other end face. Each conductive thread 3 consists of a gold-plated brass thread, and adhered and secured by bending it roughly in a U shape on the surface, one side and the backside of the insulative rubber sheet 2A, so as to clamp the insulative foam elastomer 15 therebetween. Each conductive thread 3 functions such that each conductive thread 3 on the surface of the insulative rubber sheet 2A contacts with an electrode of an electronic circuit board, and each conductive thread 3 on the backside contacts with an electrode of the subject electronic circuit board.

The insulative protective rubber sheet 11 is molded by using a high-hardness silicone rubber excellent in resilience, heat resistance, cold resistance, weatherablity, moisture resistance, chemical resistance, aging resistance and electric insulating property. This insulative protective rubber sheet 11 is molded in a flat rectangular plate form having a thickness of from 0.05 mm to 0.5 mm, and molded on the other side on the periphery of the insulative foam elastomer 15 on the same level in a buried form and the surface thereof is exposed. Moreover, the deformation-restraining rubber sheet 14 is molded in a flat rectangular plate form having a thickness of from 0.05 mm to 0.5 mm, using a silicone rubber having high hardness, and is adhered and secured in an oblong state on a portion where it is not involved in the electrical interconnection between the electronic circuit board and the subject electronic circuit board and does not come into contact with the electrode, specifically, on a plurality of conductive threads 3 on one side of the insulative rubber sheet 2A.

In the above construction, if the electrical interconnector 17 is pressed against and clamped between a pair of electronic circuit board and subject electronic circuit board disposed upper and lower sides, the plurality of conductive threads 3 on the surface of the insulative rubber sheet 2A is brought into contact with the electrode of the electronic circuit board and the plurality of conductive threads 3 on the backside thereof is brought into contact with the subject electronic circuit board, and thereafter the electronic circuit board is pressed down, the electrical interconnector 17 is elastically deformed to thereby interconnect electrically and softly the electronic circuit board and the subject electronic circuit board through the plurality of conductive threads 3.

A method for producing the press-contact electrical interconnector will now be described. To produce the electrical interconnector 17 of this embodiment, an insulative rubber sheet 2A having a plurality of conductive threads parallel to each other, a sheet laminate 4 obtained by laminating an unvulcanized insulative silicone rubber material 6 having high hardness on a base material sheet 5, a die 7 having a molding space (cavity) 9 roughly in a U shape in section, and a laminated foam 10 obtained by laminated an insulative protective rubber sheet 11 having high hardness on a sponge silicone rubber material 12 are prepared.

Figure 3:
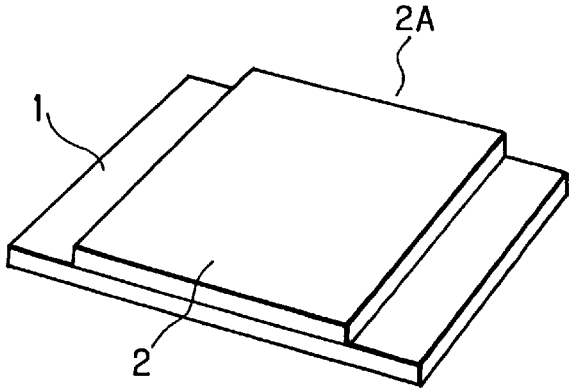
FIG. 3 is a perspective view showing a state that an insulative rubber sheet is formed in an embodiment of a method for producing a press-contact electrical interconnector according to the present invention.

First, the insulative rubber sheet 2A is produced. To produce the insulative rubber sheet 2A, the silicone rubber material 2 is sheeted on a long base material sheet 1 made from PET by using an unillustrated calender roll, to thereby form a basic insulative rubber sheet 2A shown in FIG. 3. As the silicone rubber material 2, a material obtained by adding and mixing a predetermined silicone rubber compound, a vulcanizing agent and a silane coupling agent are used.

Then, the insulative rubber sheet 2A is cut into a predetermined length, the insulative rubber sheet 2A is fixed on the periphery of a rotary drum to position the silicone rubber material 2 on the surface side, and the rotary drum is rotated, while supplying the conductive threads 3 from a feed section of an unillustrated feed apparatus onto the silicone rubber material 2. At this time, the feed section of the feed apparatus is gradually moved in the axial direction of the rotary drum, and the plurality of conductive threads 3 are arranged in parallel on the entire surface of the insulative rubber sheet 2A. After arrangement of the plurality of conductive threads 3 has been completed, the rotary drum is stopped and removed, to thereby form an insulative rubber sheet 2A1 shown in FIG. 4 wherein a plurality of conductive threads 3 are arranged.

Figure 5:
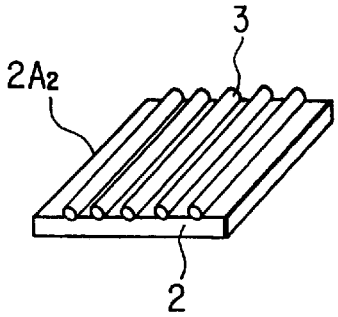
FIG. 5 is a perspective view showing a state that the insulative rubber sheet in FIG. 4 has been subjected to primary vulcanization, removal of a base material sheet, secondary vulcanization and the like, FIG. 6 is a perspective view showing a state that the insulative rubber sheet in FIG. 5 is cut to produce a final insulative rubber sheet.
Figure 6:
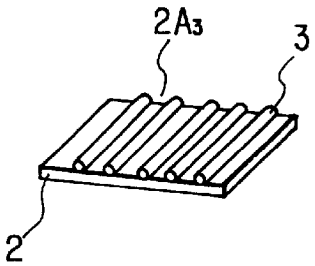

Next, the insulative rubber sheet 2A is heated in an oven for a predetermined period of time to perform primary vulcanization, the base material sheet 1 is peeled off and removed, the remaining insulative rubber sheet 2A2 is heated in an oven for a predetermined period of time to perform secondary vulcanization, to thereby form an insulative rubber sheet 2A2 shown in FIG. 5. Then, the insulative rubber sheet 2A2 is cut in the direction across the conductive threads 3 to produce an insulative rubber sheet 2A3 (see FIG. 6).

Figure 8A:
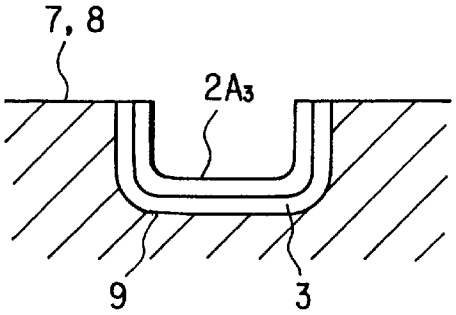
FIG. 8A is a sectional view showing a state that an insulative rubber sheet is received and intimately fitted in a molding space of a molding drag in a first embodiment of a method for producing a press-contact electrical interconnector according to the present invention.

In the first embodiment of the present invention, after the insulative rubber sheet 2A3 has been produced, the insulative rubber sheet 2A3 is bent roughly in a U shape in section and received and intimately fitted in the molding space 9 of the molding drag 8, as shown in FIG. 8A. At this time, the plurality of conductive threads 3 of the insulative rubber sheet 2A3 are made to face the molding face of the molding space 9 and to intimately contact with the molding face.

Figure 9:
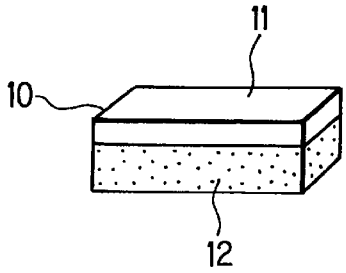
FIG. 9 is a perspective view showing a laminated foam in an embodiment of a method for producing a press-contact electrical interconnector according to the present invention.

Next, the laminated foam 10 is produced. To produce the laminated foam 10, the sponge silicone rubber material 12 is sheeted on an insulative protective rubber sheet 11 by using an unillustrated calender roll to a predetermined thickness, and subsequently cutting it into a predetermined width and length (see FIG. 9). The insulative protective rubber sheet 11 is molded by adding and mixing a predetermined vulcanizing agent in a silicone rubber compound to produce a sponge silicone rubber material 12, sheeting the sponge silicone rubber material 12 on an unillustrated base material sheet made from PET to a predetermined thickness by the calender roll, and heating and vulcanizing in an oven for a predetermined period of time. As the silicone rubber material 12, a material obtained by adding and mixing a predetermined vulcanizing agent and a foaming agent in the silicone rubber compound is used.

The laminated foam 10 is produced in this manner. Then, the laminated foam 10 is inserted upside down into an inner floor of the insulative rubber sheet 2A3 via a gap. At this time, the protective rubber sheet 11 of the laminated foam 10 is oriented to the opening direction of the insulative rubber sheet 2A3 (in the upper direction in FIG. 10A).

Figure 10A:
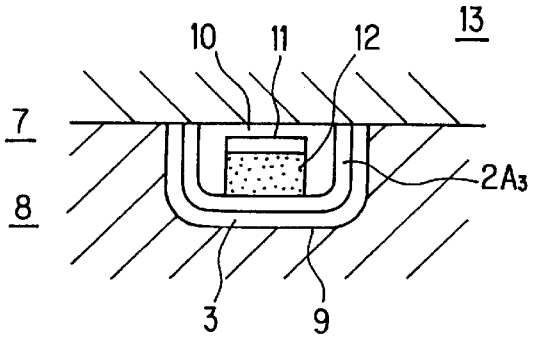
FIG. 10A is a sectional view showing a state that a laminated foam is inserted into the insulative rubber sheet of FIG. 8A.

After having arranged the laminated foam 10 within the insulative rubber sheet 2A3, as shown in FIG. 10A, a molding cope 13 is clamped against the molding drag 8 and heated under pressing, a sponge silicone material 12 of the laminated foam 10 is foamed and molded into an insulative foam elastomer 15, while the insulative foam elastomer 15 and the inner peripheral face of the insulative rubber sheet 2A3, and the insulative foam elastomer 15 and the protective rubber sheet 11 are integrally molded respectively. By this molding, an electrical interconnector article 17A is formed, wherein the both end faces are formed as insulative exposed faces 15A, and the protective rubber sheet 11 is provided in a buried condition on the remaining part of the periphery of the insulative foam elastomer 15 on the same level, and a part thereof is exposed.

Figure 11A:
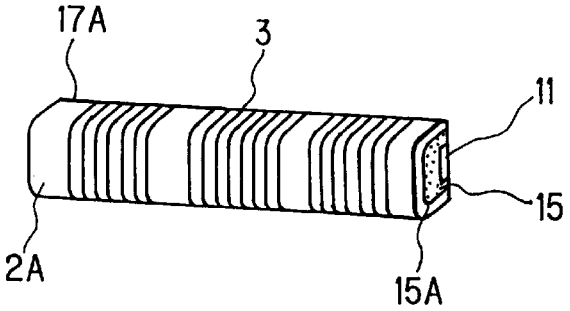
FIG. 11A is a perspective view showing an electrical interconnector molded article in the first embodiment of a method for producing a press-contact electrical interconnector according to the present invention.
Figure 12A:
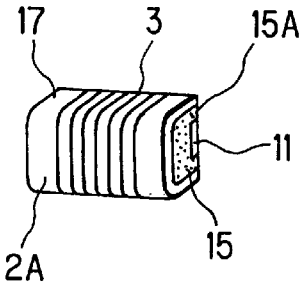
FIG. 12A is a perspective view showing a state that the electrical interconnector molded article in FIG. 11A is cut into a predetermined length.

Then, the die 7 is opened to take out the electrical interconnector article 17A, and subjecting the electrical interconnector article 17A to post curing (secondary vulcanization) under predetermined conditions, to thereby form a long bar-shaped electrical interconnector article 17A (see FIG. 11A). Thereafter, the electrical interconnector article 17A is cut into a predetermined size and length, to thereby produce the electrical interconnector article 17A in a single number or plural numbers (see FIG. 12A). The other parts are the same as the conventional example, therefore the description thereof is omitted.

Figure 7:
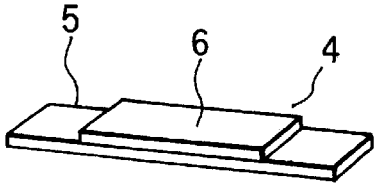
FIG. 7 is a perspective view showing a sheet laminate in an embodiment of a method for producing a press-contact electrical interconnector according to the present invention.

Next, in the second embodiment, a sheet laminate 4 is produced. To produce the sheet laminate 4, after sheeting a silicone rubber material 6 on a long base material sheet 5 made from PET, using an unillustrated calender roll, cutting it to a predetermined size, to obtain a sheet laminate 4 shown in FIG. 7. As the silicone rubber material 6, a material obtained by adding and mixing a predetermined silicone rubber compound and a vulcanizing agent is used.

Figure 8B:
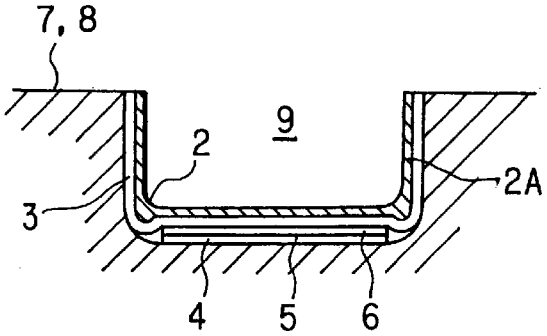
FIG. 8B is a sectional view showing a state that a sheet laminate and an insulative rubber sheet are in turn received in a molding space of a die in a second embodiment of a method for producing a press-contact electrical interconnector according to the present invention.

After production of the insulative rubber sheet 2A3 and the sheet laminate 4, as shown in FIG. 8B, the sheet laminate 4 is received in the bottom of the molding space 9 of the molding drag 8 constituting the die 7 to arrange the silicone rubber material 6 to face upward, and bend the insulative rubber sheet 2A3 roughly in a U shape in section with the plurality of conductive threads 3 exposed outside to thereby be received therein and intimately fitted thereto. At this time, the plurality of conductive threads 3 are brought into contact with the silicone rubber material 6 of the sheet laminate 4, and having the plurality of conductive threads 3 of the insulative rubber sheet 2A3 face to the molded face of the molding space 9 and intimately contact therewith.

Also in the second embodiment, as in the first embodiment, after production of the laminated foam 10, the laminated foam 10 is inserted upside down into an inner floor of the insulative rubber sheet 2A3 via a gap. At this time, the insulative protective rubber sheet 11 of the laminated foam 10 is oriented to the opening direction of the insulative rubber sheet 2A3 (in the upper direction in FIG. 10B).

Figure 10B:
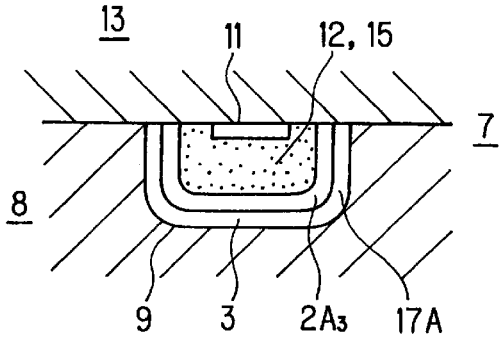
FIG. 10B is a sectional view showing a die clamping state in the first embodiment of a method for producing a press-contact electrical interconnector according to the present invention.

After having arranged the laminated foam 10 in the insulative rubber sheet 2A3, as shown in FIG. 10B, a molding cope 13 is clamped against the molding drag 8 and heated under pressing, the silicone rubber material 6 and the plurality of conductive threads 3 are bonded to form the silicone rubber material 6 into a deformation-restraining rubber sheet 14. Moreover, a sponge silicone material 12 of the laminated foam 10 is foamed into an insulative foam elastomer 15, while the inner peripheral face of the insulative rubber sheet 2A3 and the insulative foam elastomer 15, and the insulative foam elastomer 15 and the insulative protective rubber sheet 11 are integrally molded respectively. By this molding, an electrical interconnector intermediate body 16 is formed, wherein the both end faces 15A are formed as insulative exposed faces, the deformation-restraining rubber sheet 14 is exposed and the insulative protective rubber sheet 11 is provided in a buried condition on the other side of the insulative foam elastomer 15 on the same level, and a part thereof is exposed.

Figure 11B:
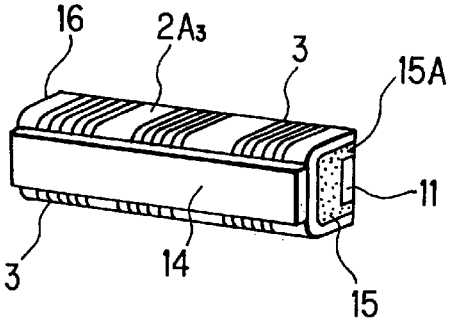
FIG. 11B is a perspective view showing an electrical interconnector intermediate body in the second embodiment of a method for producing a press-contact electrical interconnector according to the present invention.
Figure 12B:
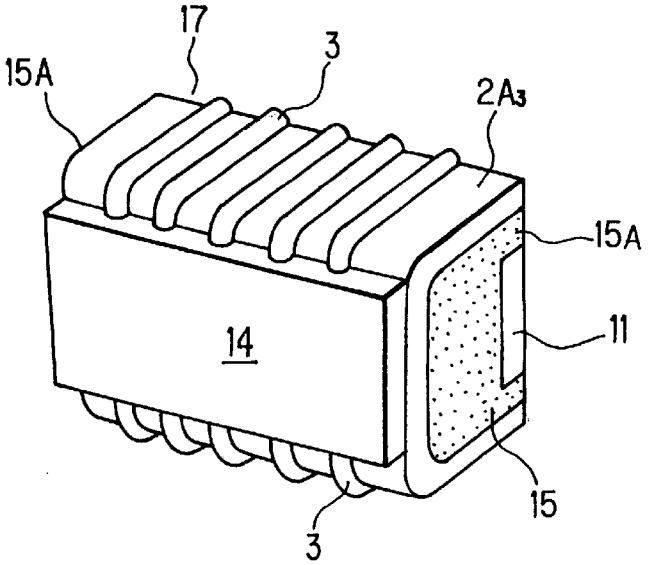
FIG. 12B is a perspective view showing a state that the electrical interconnector intermediate body in FIG. 11B is cut to thereby produce an electrical interconnector.

Then, the die 7 is opened to take out the electrical interconnector intermediate body 16 and the base material sheet 5 of the sheet laminate 4 is peeled off and removed, and the electrical interconnector intermediate body 16 is subjected to post curing (secondary vulcanization) under predetermined conditions, to thereby form a long bar-shaped electrical interconnector intermediate body 16 (see FIG. 11B). Thereafter, the electrical interconnector intermediate body 16 is cut into a predetermined size and length in the longitudinal direction by means of a cutter or the like, to thereby produce the press-contact electrical interconnector 17 in a single number or plural numbers (see FIG. 12B).

According to the present invention, the planar insulative protective rubber sheet 11 containing fillers in a large amount is provided in a buried condition on the other side on the periphery of the insulative foam elastomer 15, in other words, at a place where the plurality of conductive threads 3 do not exist, on the same level, and a part thereof is exposed. Hence, the tack effect is weakened due to the roughness on the surface of the insulative protective rubber sheet 11. That is to say, since the slip property is distinguishably improved, it hardly sticks, and even if the height of the electrical interconnector 17 is high, the assembling workability can be greatly improved, as well as the interconnection between the electronic circuit board and the subject electrical interconnector is really stabilized, hence reliable interconnection can be expected. Moreover, it becomes possible to greatly improve the initial contact property. Hence, non-interconnection between the electronic circuit board and the subject electronic circuit board can be effectively prevented, enabling stabilization of the quality.

Moreover, according to the second embodiment of the present invention, the deformation-restraining rubber sheet 14 adhered and secured at a position which is not involved in the interconnection between the electronic circuit board and the subject electronic circuit board restricts the flexure and deformation of the conductive threads 3 and the electrical interconnector 27, hence, even if the conductive threads 3 are pressed with a small force, the conductive threads 3 are not easily deformed, enabling suppression of defective ratio of products such as mobile phones. Moreover, even if a small force is applied, the surface of the electrical interconnector 17 is not easily deformed, hence the interconnection between the electronic circuit board and the subject electronic circuit board is truly stabilized, and great improvement of the assembling workability and handling easiness can also be expected. Furthermore, since the deformation-restraining rubber sheet 14 is molded in a thickness of from 0.05 mm to 0.5 mm, the electrical interconnector 17 does not become large, and the electrode design of the electronic circuit board and the subject electronic circuit board is not adversely affected.

Moreover, since the tack effect is weakened, it becomes possible to effectively prevent the partial deformation of the electrical interconnector 17. Furthermore, since the both end faces 15A of the insulative foam elastomer 15 are formed as insulative exposed faces, conductive burrs are not caused, hence the insulated state can be always maintained.

In the above embodiment, the insulative foam elastomer 15 having roughly a rectangular section is shown, but the present invention is not limited to this shape, and an insulative foam elastomer 15 of a similar shape in section, such as a half oblong shape may be used. Moreover, the insulative foam elastomer 15 may be exposed in a state that the insulative protective rubber sheet 11 is slightly projected from the other side of the periphery of the insulative foam elastomer 15. Furthermore, the number, the size, the shape or the like of the deformation-restraining rubber sheet 14 can be properly increased/decreased or varied. Moreover, a plurality of conductive threads 3 may be disposed in parallel on the surface of the insulative rubber sheet 2A by means of gradually moving the rotary drum at a certain speed. Furthermore, the laminated foam 10 may be produced in advance prior to molding.

EXAMPLES

The production method of the electrical interconnector 17 will now be described In detail with reference to the production process illustrated in FIG. 3 to FIG. 12B.

A long base material sheet 1 consisting of a PET sheet having a thickness of 50 $\mu$m and a width of 350 mm, being a non-contractable base material, was first prepared. Also, a silicone rubber material 2 was prepared by adding and mixing the vulcanizing agents C-19A, B (product name, produced by Shin-Etsu Kagaku Kogyo) in an amount of 0.5 and 0.25 part by weight, respectively, and 1.0 part by weight of a silane coupling agent KBM403 (above-mentioned) into 100 parts by weight of a silicone rubber compound KE-153U (above-mentioned) having a rubber hardness of 50° H. After completion of preparation in this manner, the silicone rubber material 2 was sheeted onto the base material sheet 1 by an unillustrated calender roll, so that it has a thickness of 100 $\mu$m and a width of 300 mm, to thereby form an insulative rubber sheet 2A.

Then, the insulative rubber sheet 2A was cut into a 600 mm length, which was then fixed on the periphery of the rotary drum having a circumference of 600 mm so that the insulative rubber sheet 2A became outside, and conductive threads 3 consisting of a gold-plated brass thread having a diameter of 40 $\mu$m were supplied from a feed apparatus onto the rotating rotary drum. At this time, after the conductive threads 3 had been disposed in 10 mm in the axial direction of the rotary drum, while shifting the feed section of the conductive threads 3 by 100 $\mu$m per one rotation in the axial direction of the rotary drum at a pitch of 100 $\mu$m, the rotary drum was rotated once, to shift the feed section of the conductive threads 3 by 0.4 mm in the axial direction of the rotary drum, and thereafter, the conductive threads 3 were subsequently disposed in 10 mm in the axial direction at a pitch of 100 $\mu$m.

Figure 4:
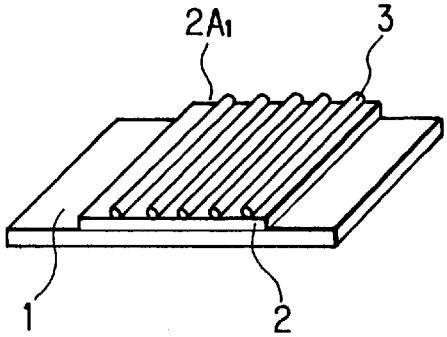
FIG. 4 is a perspective view showing a state that a plurality of conductive threads are provided in proximity in a row arrangement on an insulative rubber sheet in FIG. 3.

This operation was repeated to dispose a plurality of conductive threads 3 on the entire periphery of the insulative rubber sheet 2A, and at the time of completion of disposition thereof, the rotation of the rotary drum was stopped and the insulative rubber sheet 2A with the conductive threads were removed from the rotary drum, and the conductive threads 3 on the 0.4 mm shifted position was removed to thereby form an insulative rubber sheet 2A1 shown in FIG. 4.

Then, the insulative rubber sheet 2A2 was heated in an oven at 120° C. for 30 minutes to effect the primary vulcanization, the base material sheet 1 was peeled off and removed, and then the insulative rubber sheet 2A2 was heated again in an oven at 195° C. for 4 hours to effect the secondary vulcanization, to thereby obtain the insulative rubber sheet 2A2 shown in FIG. 5. After formation of the insulative rubber sheet 2A2 shown in FIG. 5 in this manner, the insulative rubber sheet 2A2 was cut in the direction across the conductive threads 3 to produce an insulative rubber sheet 2A3 having a width of 8.0 mm and a length of 300 mm (see FIG. 6).

Then, in the first embodiment of the present invention, as shown in FIG. 8A, the insulative rubber sheet 2A3 was set in the molding drag 8 having a molding space 9 in a U shape with the conductive threads 3 of the insulative rubber sheet 2A3 facing the molding face. Also, a silicone rubber material was prepared by adding and mixing vulcanizing agents C-19A, C-198 (product name, produced by Shin-Etsu Kagaku Kogyo) in an amount of 0.3 and 2.5 part by weight, respectively, into 100 parts by weight of a silicone rubber compound KE-981 (above-mentioned) having a rubber hardness 80° H. This silicone rubber material was sheeted by a calender roll, and heated in an oven at 300° C. for 1 minute to effect vulcanization, to thereby form a protective rubber sheet 11 having a thickness of 10 $\mu$m.

Meanwhile, vulcanizing agents C-1, C3 (product name, produced by Shin-Etsu Kagaku Kogyo) in an amount of 0.5 and 2.0 parts by weight, respectively, and 1.8 parts by weight of a foaming agent 2,2-azobis-isobutylnitrile were added and mixed into 100 parts by weight of a silicone rubber compound KE-151U (above-mentioned), to thereby prepare a sponge silicone rubber material 12. After the preparation had been completed, the sponge silicone rubber material 12 was sheeted onto the protective rubber sheet 8 in a thickness of 1.8 μm to prepare a laminate, which was cut in a size of 3 mm in height, 1.9 mm in width and 300 mm in length to prepare a laminated foam 10 (see FIG. 9). Then, the laminated foam 10 was placed on the inner floor of the insulative rubber sheet 2A3 as shown in FIG. 10A.

Subsequently, the molding cope 13 was put on the molding drag 8 and clamped, then they were heated at 175° C. for 5 minutes under a pressing load of 10 kg/cm$^2$, to foam and mold the sponge silicone rubber material 12, which was designated as the insulative foam elastomer 12 (see FIG. 10B).

Then, the electrical interconnector article 17A was taken out from the opened die 7, and subjected to the post curing at 200° C. for 1 hour, to obtain a long electrical interconnector article 17A shown in FIG. 11A. Thereafter, the electrical interconnector article 17A was cut at the 0.4 mm shifted position where the conductive threads 3 were not disposed and the insulative rubber sheet 2A3 was exposed (preferably cut at the central portion of the shifted position), to thereby prepare the electrical interconnector 17 having a length of 10.4 mm, a height of 4 mm and a width of 2 mm.

The obtained electrical interconnector 17 had excellent workability even if the height was large. Moreover, there was no such a problem that an interconnection between a liquid crystal display and the circuit board or between electronic circuit boards could not be obtained because a predetermined contact of the electrical interconnector 17 pressing against the electronic circuit board and the subject electronic circuit board could not be obtained. Moreover, non-interconnection of a circuit was not caused.

In the second embodiment of the present invention, subsequent to the production of the insulative rubber sheet 2A3, a long base material sheet 5 consisting of a PET sheet having a thickness of 50 μm and a width of 350 mm, being a non-contractable base material, was prepared. Also, a silicone rubber material 6 was prepared by adding and mixing vulcanizing agents C-19A, B (product name, produced by Shinetsu Kagaku Kogyo) in an amount of 0.3 and 2.5 parts by weight, respectively, into 100 parts by weight of a silicone rubber compound KE-981 (above-mentioned) having a rubber hardness of 80° H. After completion of preparation in this manner, the silicone rubber material 6 was sheeted onto the base material sheet 5 by an unillustrated calender roll, so that it has a width of 4.0 mm and a length of 300 mm to thereby form a sheet laminate 4 (see FIG. 7).

Then, as shown in FIG. 8, the sheet laminate 4 was received and arranged in the molding drag 8 having a molding space 9 in a U shape, and set so that the conductive threads 3 side of the insulative rubber sheet 2A3 faces the molding face. Meanwhile, the vulcanizing agents C-19A, C-19B (product name, produced by Shinetsu Kagaku Kogyo) in an amount of 0.3 and 2.5 parts by weight, respectively, were added and mixed into 100 parts by weight of a silicone rubber compound KE981 (above-mentioned), and this silicone rubber material was sheeted by a calender roll, and heated and vulcanized in an oven at 300° C. for 1 minute, to thereby form an insulative protective rubber sheet 11 having a thickness of 10 μm.

Figure 10C:
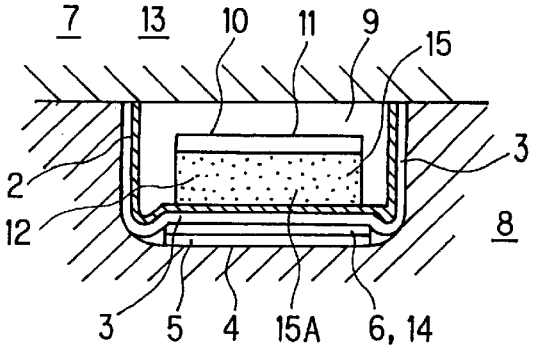
FIG. 10C is a sectional view showing a state that a laminated foam is inserted into the insulative rubber sheet of FIG. 8B.

Furthermore, vulcanizing agents C-1, C3 (product name, produced by Shin-Etsu Kagaku Kogyo) in an amount of 0.5 and 2.0 parts by weight, respectively, and 1.8 parts by weight of a foaming agent 2,2-azobis-isobutylnitrile were added and mixed into 100 parts by weight of a silicone rubber compound KE-151U (above-mentioned), to thereby prepare a sponge silicone rubber material 12. After the preparation had been completed, the sponge silicone rubber material 12 was sheeted onto the insulative protective rubber sheet 11 in a thickness of 1.8 μm to prepare a laminate, which was cut in a size of 3 mm in height, 1.9 mm in width and 300 mm in length to prepare a laminated foam 10 (see FIG. 9). Then, the laminated foam 10 was placed on the inner floor of the insulative rubber sheet 2A3 as shown in FIG. 10*c*.

Subsequently, the molding cope 13 was put on the molding drag 8 and clamped, then they were heated at 175° C. for 5 minutes under a pressing load of 10 kg/cm$^2$, to foam and mold the sponge silicone rubber material 12, which was designated as the insulative foam elastomer 15 (see FIG. 11B).

Then, the electrical interconnector intermediate body 16 was taken out from the opened die 7, the base material sheet 5 of the sheet laminate 4 was peeled off, and the electrical interconnector intermediate body 16 was subjected to the post curing at 200° C. for 1 hour, to obtain a long electrical interconnector intermediate body 16 shown in FIG. 11B. Thereafter, the electrical interconnector intermediate body 16 was cut at the 0.4 mm shifted position where the conductive threads 3 were not disposed and the insulative rubber sheet 2A3 was exposed (preferably cut at the central portion of the shifted position), to thereby prepare the electrical interconnector 17 shown in FIG. 12.

The obtained electrical interconnector 17 did not deform at all even if a small force was applied to the spot where the deformation-restraining rubber sheet 14 existed. Moreover, even if the height was large, the workability was excellent. Furthermore, there was no such a problem that an interconnection between a liquid crystal display and a circuit board or between electronic circuit boards could not be obtained because a predetermined contact of the electrical interconnector 17 by pressing against the electronic circuit board and the subject electronic circuit board could not be obtained. Moreover, non-interconnection of a circuit was not caused.

COMPARATIVE EXAMPLES

In the case of the electrical interconnector 17 without the insulative protective rubber sheet 11 and the deformation-restraining rubber sheet 14, even if a small force was applied onto one side of the conductive threads 3 which was not involved in the interconnection between a liquid crystal display and a circuit board or between electronic circuit boards, the electrical interconnector 17 was easy deformed, and non-interconnection was caused often. Moreover, when the height of the electrical interconnector 17 was large, the workability was deteriorated. Furthermore, since a predetermined contact of the electrical interconnector 17 by pressing against an electronic circuit board was not obtained, no interconnection was easily caused in the interconnection between a liquid crystal display and a circuit board or between electronic circuit boards, thus non-interconnection of a circuit occurred.

As described above, according to the gist first and third, since the slip property is improved, it hardly sticks, and even if the height of the electrical interconnector is large, the assembling workability can be improved, as well as the interconnection between the electronic circuit board and the subject electrical interconnector is stabilized, hence reliable interconnection can be expected. Hence, non-interconnection between an electrical joiner and an object to be electrically interconnected can be eliminated, enabling the quality to be stabilized. Moreover, since the tacking effect is weakened, a partial deformation of the electrical interconnector can be effectively prevented. Furthermore, since the both end faces of the insulative foam elastomer are formed as the insulative exposed face, respectively, burrs due to the conductive threads are not caused, hence the insulated state can be maintained.

Furthermore, according to the gist second and fourth, such effects can be obtained that the surfaces of the conductive thread and the electrical interconnector can be prevented from being easily deformed by the application of a small force, through which the defective ratio of products can be reduced. Moreover, interconnection between the electrical joiner and the object to be electrically interconnected can be stabilized, and improvement of the assembling workability can be expected.

What is claimed is:

1. A press-contact electrical interconnector for interconnecting an electrical joiner and an object to be electrically interconnected by being disposed between the electrical joiner and the object to be electrically interconnected, wherein said electrical interconnector comprises an insulative foam elastomer formed in a columnar shape having a section roughly in a U shape; an insulative rubber sheet having a section roughly in a U shape, which covers a part of the periphery of the insulative foam elastomer; and a plurality of conductive threads provided roughly in a U shape on a surface of the insulative rubber sheet and juxtaposed at roughly equal pitches from one end face toward the other end face of the insulative foam elastomer;

the both end faces of the insulative foam elastomer being formed as an insulative exposed face, respectively, and an insulative protective rubber sheet of high hardness being provided in an exposed state on the remaining part of the periphery of the insulative foam elastomer.

2. A press-contact electrical interconnector for interconnecting an electrical joiner and an object to be electrically interconnected by being pinched between the electrical joiner and the object to be electrically interconnected, wherein the electrical interconnector comprises an insulative foam elastomer; an insulative rubber sheet having a section roughly in a U shape which covers a first surface, a first side surface and a second surface opposite the first surface of the insulative foam elastomer, while exposing both end faces and a second side surface of the insulative foam elastomer; a plurality of conductive threads provided roughly in a U shape on the insulative rubber sheet and juxtaposed at roughly equal pitches from one end face toward the other end face of the insulative foam elastomer; and an insulative protective rubber sheet of high hardness provided on the second side surface of the insulative foam elastomer;

either one of the plurality of conductive threads on the first surface of the insulative rubber sheet and the plurality of conductive threads on the second surface thereof being capable of contacting with the object to be electrically interconnected and the plurality of conductive threads on the first side surface of the insulative rubber sheet being provided with an insulative deformation-restraining rubber sheet of high hardness.

3. The press-contact electrical interconnector of claim 1, wherein the insulative rubber sheet has first and second opposing ends which are flush with the ends faces of the insulative foam elastomer.

4. The press-contact electrical interconnector of claim 2, wherein the insulative rubber sheet has first and second opposing ends which are flush with the ends faces of the insulative foam elastomer.

* * * * *